United States Patent [19]

Frestadius et al.

[11] Patent Number: 4,733,606

[45] Date of Patent: Mar. 29, 1988

[54] CLOSURE DEVICE

[75] Inventors: Klaus Frestadius; Matti Purhonen, both of Helsinki, Finland

[73] Assignee: Temet OY, Helsinki, Finland

[21] Appl. No.: 50,149

[22] Filed: May 14, 1987

[30] Foreign Application Priority Data

May 15, 1986 [FI] Finland ..... 862040

[51] Int. Cl.[4] ..... F24F 11/00

[52] U.S. Cl. ..... 98/119; 137/512.1; 137/517; 137/529

[58] Field of Search ..... 98/119, DIG. 2; 137/512.1, 517, 529

[56] References Cited

U.S. PATENT DOCUMENTS

| | | | |
|---|---|---|---|
| 3,015,342 | 1/1962 | Price | 137/512.1 |
| 3,296,952 | 1/1967 | Lingal | 98/119 |
| 3,301,168 | 1/1967 | Schindler et al. | 98/119 |
| 4,495,964 | 1/1985 | Bennitt | 137/512.1 |

FOREIGN PATENT DOCUMENTS

| | | |
|---|---|---|
| 50683 | 10/1976 | Finland . |
| 2121142 | 1/1983 | United Kingdom . |

*Primary Examiner*—Harold Joyce
*Attorney, Agent, or Firm*—Cesari and McKenna

[57] ABSTRACT

A closure device for shelters and the like. The frame (1) of the closure device is provided with at least one flow-through passage (2); a closure (3) is mounted displaceably in each passage; and a counter part is formed in the frame for each closure. The closure is displaceable between an open position, which permits a normal air flow, and a closed position, which may be caused by a pressure shock, in which the closure means is pressed against the counter part so as to close the respective passage. The objective is to provide a simple and steady structure, the operation of which is as efficient as possible. Accordingly, the passage (2) is defined by substantially U-shaped elements/partial elements (5*a*, 5*b*) which open towards each other in the direction of flow. The element/partial element (5*a* and 5*b* respectively) on the incoming side of a flow (A or B) is arranged to function as a flow guide element, and the element/partial element (5*b* and 5*a*, respectively) on the exhaust side of the flow (A or B) is arranged to function as a suppressing element for the pressure shock.

8 Claims, 3 Drawing Figures

CLOSURE DEVICE

BACKGROUND OF THE INVENTION

1. Field of the Invention

This invention relates to a closure device comprising a frame provided with at least one flow-through passage, a closure means mounted displaceably for each passage, and a counter part formed in the frame for each closure means. The closure means is displaceable between an open position, which permits a normal air flow, and a closed position, which may be caused by a pressure shock, in which the closure means is pressed against the counter part so as to close the respective passage.

2. Description of the Prior Art

Shelters for apparatus and people are usually provided with some kind of a ventilation system. In order to provide effective protection against an explosion taking place outside the bomb shelter, the ventilation system has to comprise a closure device or valve which prevents a pressure shock caused by the explosion from entering the shelter. The closure device or valve has to close immediately as a result of the pressure shock caused by the explosion; on the other hand, it has to stay open under normal conditions to allow the exhaust and supply of air.

In the most commonly used structures the closure means is formed by an axially displaceable disc or a pivotable flap. In such devices, the pivoting or sliding movement of the closure means also causes sliding or torsional friction, which may prevent a disturbance-free operation of the device due to wear and dirt.

In another device known in the prior art, the frame of the device is provided with flow-through openings, whereby a rodlike closure means is provided for each opening. The closure means are supported by springs so as to be fixed with respect to the frame. Due to the fixed spring system, the inherent rolling movement of the cylindrical closure means is prevented. In addition, spring systems have such general disadvantages as the fatigue, wear and corrosion of the springs.

Attempts to avoid disadvantages of spring systems in structures of the above kind have been made by substituting springs with the force of gravity; however, a steady disturbance-free operation thereby seems questionable.

SUMMARY OF THE INVENTION

The objective of the present invention is to provide a closure device which eliminates the above disadvantages. Furthermore, it is required that the device is simple and steady in structure so that a sensitive and disturbance-free operation can be guaranteed when required without any need of tests and maintenance at regular intervals. This object is achieved by means of a closure device according to the invention, which is characterized in that:

the passage is formed between substantially U-shaped elements/partial elements opening towards each other in the direction of flow;

the element/partial element positioned on the incoming side of a flow is arranged to function as a flow guiding element; and the element/partial element positioned on the exhaust side of the flow being arranged to function as a suppressing element for the pressure shock.

The basic idea of the solution, according to the invention, is that the closure means positioned in the frame of the closure device are light and rapid in movement in view of operational objectives and that their support and guide elements are simple and guarantee an efficient operation. This is achieved by forming the closure means of cylindrical pipes in such a manner that their natural movement, i.e. rolling, is possible. Accordingly, the closure means are arranged to move in oblong guide grooves which are formed in the end plates of the frame and which are parallel with the direction of flow. Another part of the guide means is formed by retaining means positioned on both sides of the closure means, i.e. spring strips provided on the outside of the end plates. These spring strips keep the closure means substantially in the middle of their respective guide grooves during normal air flow. In the closure device so obtained, as seen from the incoming side of a potential pressure wave, a pressure flow created by a pressure wave front reaching the closure device acts directly on the closure means by virtue of the guide elements so that the closure means are immediately pressed into the closed position. The elements which are positioned on the other side and which open towards the direction of flow act as pockets which suppress the pressure wave. During normal air flow, the guide elements settle the incoming air flow across a broad front so that the air flow has time to find the flow-through points and, as a result, the formation of an uneven turbulent flow is avoided. In this situation the "pockets" positioned on the opposite side do not disturb the flow since a normal atmospheric pressure prevails therein.

BRIEF DESCRIPTION OF THE DRAWINGS

The invention will be described in more detail by means of the following drawings, wherein.

DETAILED DESCRIPTION OF AN ILLUSTRATIVE EMBODIMENT

Figure 1:
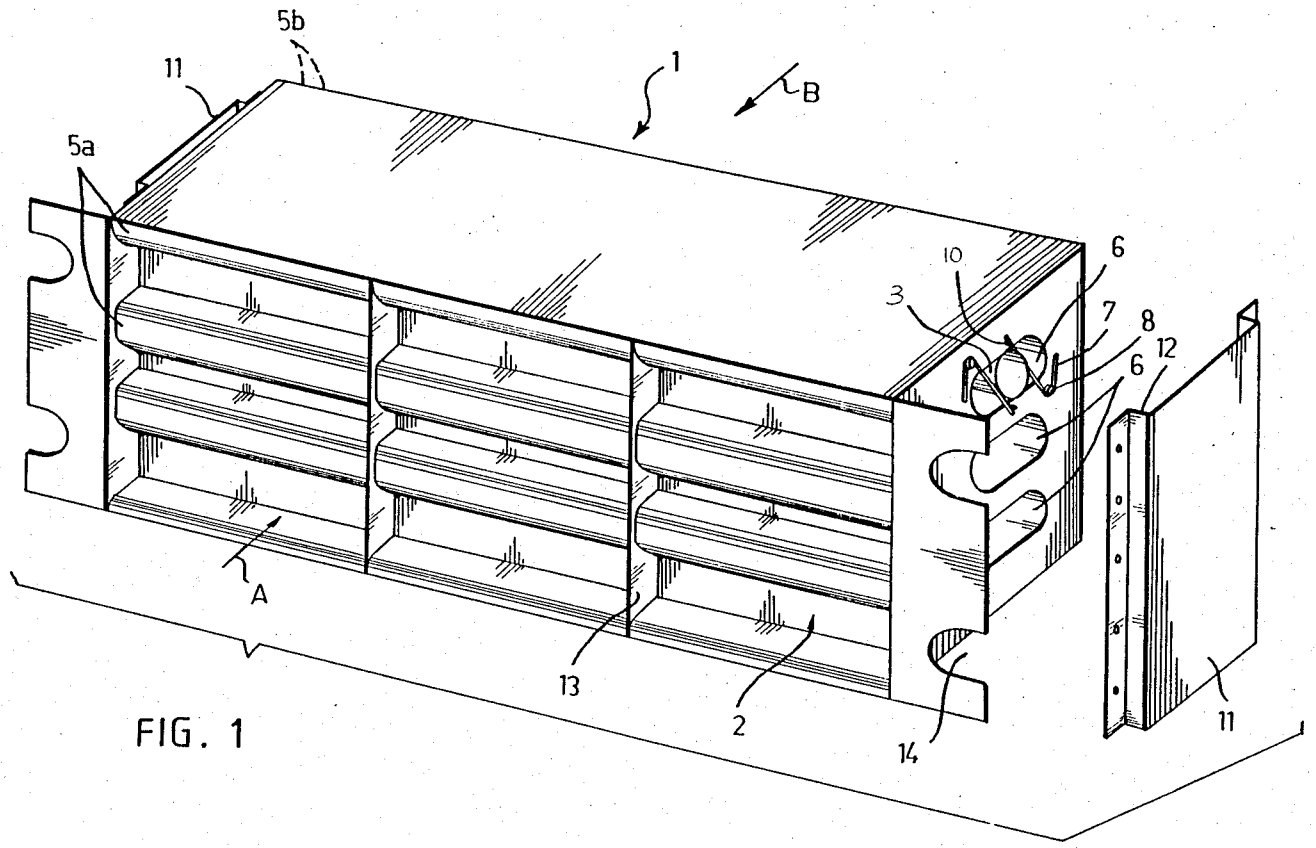
FIG. 1 illustrates a closing device as seen from the inside of a shelter.

FIG. 1 shows a closure device 1 according to one embodiment. The device is shown in such a way that the side facing the viewer if intended to be mounted towards the inside of a shelter. The closure device is fixed to a wall or the like at fastening holes 14. Supporting ribs 13 are intended to reinforce the structure against a potential pressure shock coming in the direction of flow B, i.e. from the outside of the shelter. Flow-through passages 2 are formed between guide elements/partial elements 5*a*, 5*b*. Retaining elements 7 are positioned on the outside of an end plate 10 adjacent to guide grooves 6 in which closure means 3 are movable. The retaining elements, i.e. springs strips, are supported by pins 8, e.g. rivets, in such a manner that the closure means 3 are maintained substantially in the middle of the guide grooves 6. Thus, the springs 7 on one side rest on counter parts 9 (FIG. 2) and on the other side on inner surfaces 12 of a cover plate 11. The cover plate 11 also maintains the closure means 3 in position by preventing its lateral movement.

Figure 2:
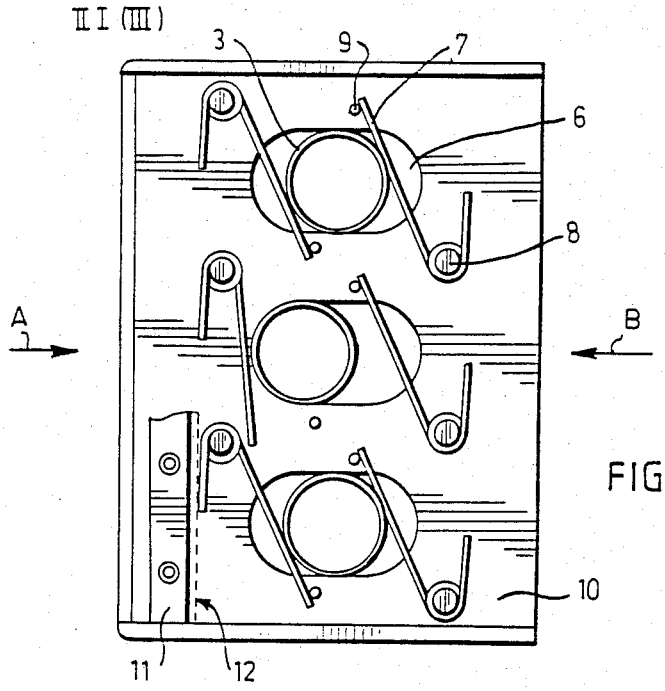
FIG. 2 is a sectional view from the end plates of the closure device.

FIG. 2 shows the closure device 1 from the end plate 10. The end plate is provided with oblong guide grooves 6 in which the displaceable closure means 3 is disposed. Two retaining elements 7, e.g. spring strips, are provided for each closure means, and the retaining elements are supported by supports 8, such as rivets provided in the end plates. Under normal conditions, i.e. during normal air flow, the closure means are arranged to stay in an open position I, whereby the retaining elements rest on the counter parts 9 and, on the other hand, on the side surface 12 or the cover plate 11. In addition, the closure means 3 are stressed such that they are not displaced to closed position II or (III) due to a pressure loss created during normal flow. On the other hand, the stress is also arranged such that the closure means 3 are displaced to closed position (III) due to an underpressure state occurring after a nuclear explosion.

Figure 3:
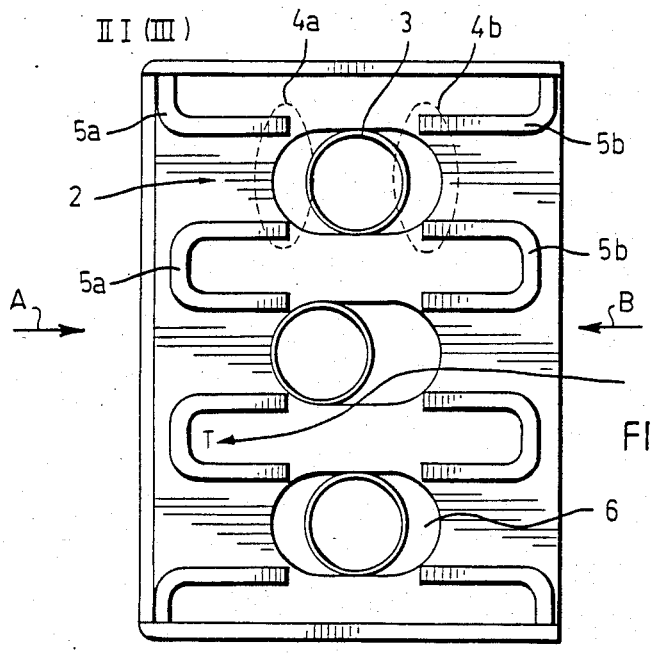
FIG. 3 is a sectional view from within the closure device.

FIG. 3 shows a sectional view from within the closure device 1. The flow-through passages 2 are formed between the guide elements/partial elements 5*a*, 5*b*. The ends of the guide elements/partial elements form a counter part 4*a*, 4*b* for the movable closure means. In case of explosion, a pressure shock coming from outside the closure means, i.e., in the direction by virtue of the guide elements 5*b*. Thus, the closure means is immediately forced to closed position II. The pressure wave passes on into a pocket T formed by the element 5*a* positioned on the opposite side, which suppresses the pressure shock. The pockets T formed by the guiding elements do not disturb the flow under normal conditions, since atmospheric pressure prevails therein under normal conditions.

The closure device described above may be manufactured of e.g. stainless steel. The parts can be joined by spot welding, whereafter a required sealing effect and corrosion resistance are obtained by hot-dip galvanizing. To provide lightness and durability, the closure means may be manufactured of aluminum.

The drawings and the description related thereto are only intended to illustrate the present invention. In its details, the device according to the invention may vary considerably within the scope of the claims. The applications of the closure device as well as the shape and size of the flow-through passages, the closure means and the flow guide elements can be chosen as required.

We claim:

1. A closure device comprising a frame (1) provided with at least one flow-through passage (2), a closure means (3) mounted displaceably for each passage, a counter part (4*a*, 4*b*) formed in the frame for each closure means, the closure means being displaceable between an open position (I) permitting a normal air flow and a closure position (II) caused by a pressure shock, in which closure position the closure means is pressed against the counter part so as to close the respective passage, characterized in that the passage (2) is formed between substantially U-shaped elements/partial elements (5*a*, 5*b*) opening towards each other in the direction of flow, the element/partial element (5*a* and 5*b* respectively) positioned on the incoming side of a flow (A or B) being arranged to function as a flow guiding element, and the element/partial element (5*a* and 5*b* respectively) positioned on the exhaust side of the flow (A or B) being arranged to function as a suppressing element for the pressure shock.

2. A closure device according to claim 1, characterized in that the adjacent branches of two adjacent substantially U-shaped elements/partial elements form a counter part (4*a*, 4*b*) for the closure means (3).

3. A closure device according to claim 2, characterized in that the closure means (3) is arranged displaceably in guide grooves (6) formed in the frame in parallel with the passage (2).

4. A closure device according to claim 2, characterized in that the frame (1) is provided with retaining elements (7) which maintain the closure means (3) in the guide groove (6) substantially in the middle of the two opposite counter parts (4*a*, 4*b*).

5. A closure device according to claim 3, characterized in that the sideward displacement of the closure means (3) is prevented by means of end plates (11) provided in the frame (1).

6. A closure device according to claim 3, characterized in that the closure means (3) is a substantially cylindrical pipe.

7. A closure device according to claim 1, characterized in that the elements/partial elements (5*a* and 5*b* respectively) on the incoming side of the flow (A or B) are arranged at uniform intervals and that the elements/partial elements (5*a* and 5*b* respectively) on the exhaust side of the flow (A or B) are arranged at uniform intervals.

8. A closure device according to claim 7, characterized in that the branches of the substantially U-shaped elements/partial elements (5*a* and 5*b* respectively) on the same side are equal in length.

* * * * *